US006640601B2

(12) United States Patent
Hatty

(10) Patent No.: US 6,640,601 B2
(45) Date of Patent: Nov. 4, 2003

(54) ELECTRIC HEMMING PRESS

(75) Inventor: Thomas J. Hatty, Sterling Heights, MI (US)

(73) Assignee: Sanyo Machine America Corporation, Rochester Hills, MI (US)

( * ) Notice: Subject to any disclaimer, the term of this patent is extended or adjusted under 35 U.S.C. 154(b) by 0 days.

(21) Appl. No.: 10/017,795

(22) Filed: Dec. 14, 2001

(65) Prior Publication Data

US 2002/0078730 A1 Jun. 27, 2002

Related U.S. Application Data

(60) Provisional application No. 60/258,430, filed on Dec. 27, 2000.

(51) Int. Cl.[7] ..... B21D 39/02

(52) U.S. Cl. ..... 72/312; 72/453.03; 72/454; 72/456; 29/243.58; 100/270

(58) Field of Search ..... 72/455, 456, 453.03, 72/453.08, 454, 312; 29/243.58, 243.57; 100/269.1, 270, 271, 269.07, 269.08

(56) References Cited

U.S. PATENT DOCUMENTS

| | | | | |
|---|---|---|---|---|
| 280,929 | A | | 7/1883 | Hunt |
| 2,357,508 | A | * | 9/1944 | Ernst ..... 100/270 |
| 2,642,111 | A | | 6/1953 | Bindszus |
| 3,507,143 | A | * | 4/1970 | Georg ..... 100/269.08 |
| 3,512,476 | A | * | 5/1970 | Georg ..... 100/270 |
| 3,824,757 | A | | 7/1974 | Coop |
| 3,861,339 | A | | 1/1975 | Aida et al. |
| 3,862,490 | A | | 1/1975 | Tsuneishi et al. |
| 3,883,940 | A | | 5/1975 | Wagner |
| 3,909,918 | A | | 10/1975 | Takizawa et al. |
| 3,909,919 | A | | 10/1975 | Miyabayashi et al. |
| 4,510,660 | A | | 4/1985 | Hoeffken |
| 4,782,749 | A | * | 11/1988 | Iwasaki et al. ..... 100/271 |
| 4,891,912 | A | | 1/1990 | Bockwinkel |
| 4,897,912 | A | | 2/1990 | Slasinski |
| 5,083,355 | A | | 1/1992 | Dacey, Jr. |
| 5,150,508 | A | | 9/1992 | St. Denis |
| 5,237,734 | A | | 8/1993 | Polon |
| 5,272,903 | A | | 12/1993 | Evans |
| 5,273,606 | A | | 12/1993 | Greve et al. |
| 5,454,261 | A | | 10/1995 | Campian |
| 5,457,981 | A | | 10/1995 | Brown et al. |
| 5,647,243 | A | | 7/1997 | Zampini |
| 5,740,691 | A | | 4/1998 | Kovarovic et al. |
| 5,746,083 | A | | 5/1998 | Kovarovic et al. |
| 6,154,942 | A | * | 12/2000 | Toeniskoetter ..... 29/243.58 |
| 6,487,888 | B1 | * | 12/2002 | Baulier et al. ..... 100/269.02 |

FOREIGN PATENT DOCUMENTS

| | | |
|---|---|---|
| JP | 2-280929 | 11/1990 |
| JP | 07284858 | 10/1995 |
| JP | 11254063 | 9/1999 |

* cited by examiner

*Primary Examiner*—Daniel C. Crane
(74) *Attorney, Agent, or Firm*—Harness, Dickey & Pierce, P.L.C.

(57) ABSTRACT

A hemming press that includes a crown and a base plate separated by four corner posts. A press ram is slidably mounted on the posts between the crown and base plate. A first die is mounted to a lower surface of the press ram and a second die is mounted to an upper surface of the base plate. Workpieces to be hemmed are placed in the second die, and the press ram is moved from an upper home position to a lower hem position to perform the hemming process. Pre-hemming and final hemming steps are performed by one continuous stroke of the press ram. A pre-hem pressure is provided to the press ram by at least one electric servomotor and roller screw assembly, and a final hem pressure is provided to the press ram by at least one hydraulic actuator.

17 Claims, 4 Drawing Sheets

ELECTRIC HEMMING PRESS

CROSS-REFERENCE TO RELATED APPLICATIONS

This application claims the benefit of U.S. Provisional Application No. 60/258,430, titled "Electric Hemming Press," filed Dec. 27, 2000.

BACKGROUND OF THE INVENTION

1. Field of the Invention

This invention relates generally to a hemming press and, more particularly, to a hemming press employing electric servomotors and hydraulic cylinders for actuating a press ram, where the servomotors provide a prehem pressure and the hydraulic cylinders provide a final hem pressure.

2. Discussion of the Related Art

It is common practice, particularly in the automotive industry, to join two preformed metal panels together into a unitary structural unit by a hemming process using a hemming press. A vehicle door is one unit that is typically manufactured in this manner. Particularly, the vehicle door typically includes an outer metal panel and an inner metal panel that are hemmed together to provide the complete door unit. Before the hemming process is performed, the outer metal panel is preformed to include an outer edge flange formed perpendicular to the main portion of the outer panel. This preforming is customarily done in a stamping operation. The preformed inner and outer panels are aligned relative to each other in a press die. The hemming process moves a press ram to fold the preformed flange around an edge portion of the inner metal panel. It is important that the hemming process provides a firm, vice-like grip of the outer panel flange with the edge portion of the inner panel while maintaining the door shape and dimensions within prescribed tolerances.

Known hemming procedures are generally two stage processes. In the first stage, the outer panel with the preformed flange is placed in the press die and the inner metal panel is placed on top of the outer panel so that the edge portion aligns with the flange. The hemming press applies an exterior force to the preformed flange of the outer metal panel at an angle generally perpendicular to the flange causing the flange to bend downward toward the inner panel. This step is generally referred to as the prehemming stage. The second stage provides a second force generally parallel to the original orientation of the flange to cause the partially bent flange to bend an additional amount to contact the inner panel and complete the folding process. This step is generally referred to as the final hemming stage.

This two stage hemming process is generally done using separate sets of dies or tools. The required tooling for such an operation is rather massive, costly and space consuming. Additionally, a two stage hemming process usually requires a transfer operation to transfer the panels to be hemmed from the first stage tooling to the second stage tooling.

The prior art generally relates to improving the hemming process from a two-stage process to a one-stage process. Examples of advances in this area may be found in U.S. Pat. No. 5,083,355 entitled "Hemming Apparatus" issued Jan. 28, 1992, to Ernest A. Dacey, Jr.; U.S. Pat. No. 5,150,508 entitled "Hemming Machine and Method" issued Sep. 29, 1992, to Lucen St. Denis; U.S. Pat. No. 5,272,903 entitled "Hemming Machine" issued Dec. 28, 1993 to Owen C. Evans; U.S. Pat. No. 5,454,261 entitled "Hemming Machine and Method of Operation" issued Oct. 3, 1995 to Jon R. Campian; U.S. Pat. No. 5,457,981 entitled "Hemming Press" issued Oct. 17, 1995 to Gerald A. Brown et al.; U.S. Pat. No. 5,647,243 entitled "Device for Hemming Elements of Pressed Sheet Metal" issued Jul. 15, 1997 to Antonio Zampini; U.S. Pat. No. 5,740,691 entitled "Hemming Machine" issued Apr. 21, 1998 to Josef Kovarovic et al.; and U.S. Pat. No. 5,746,083 entitled "Hemming Machine" issued May 5, 1998 to Josef Kovarovic et al. This art typically focuses on the use of cams external to the hemming press, pre-hem and final hem die blocks and methods for forming a unitary structure within a single hemming press. Further improvements can be made to improve the hemming process.

SUMMARY OF THE INVENTION

In accordance with the teachings of the present invention, a hemming press is disclosed that includes a crown and a base plate separated by four corner posts. A press ram is slidably mounted on the posts between the crown and base plate. A first die is mounted to a lower surface of the press ram and a second die is mounted to an upper surface of the base plate. Workpieces to be hemmed are placed in the second die, and the press ram is moved from an upper home position to a lower hem position to perform the hemming process. Pre-hemming and final hemming steps are performed by one continuous stroke of the press ram.

At least one electric servomotor is mounted to a top surface of the crown, and is mechanically coupled to a linear actuator, such as a roll screw, extending through the crown. The linear actuator is rigidly mounted to a top surface of the press ram. One or more pneumatically powered hydraulic actuators are also mounted to the crown, where each actuator includes a rod that extends through openings in the press ram. The linear actuators move the press ram from the home position through a prehem position to the start position of the final hem. At the position for the start of the final hem, the rods are positioned above a top surface of the press ram. Suitable actuation devices position blocks over the openings in the press ram to provide a surface that the rods can push against. Activation of the hydraulic actuators push the press ram through the final hem position under suitable pressure to perform the hem. The contact point between the rods and the blocks is a floating contact to accommodate transverse forces on the press ram during the hemming process. The servomotors are reversed to return the press ram to the home position.

Additional objects, advantages and features of the present invention will become apparent from the following description and appended claims, taken in conjunction with the accompanying drawings.

DETAILED DESCRIPTION OF THE EMBODIMENTS

The following discussion of the embodiments of the invention directed to an electric hemming press is merely exemplary in nature and is in no way intended to limit the invention or its applications or uses.

Figure 1:
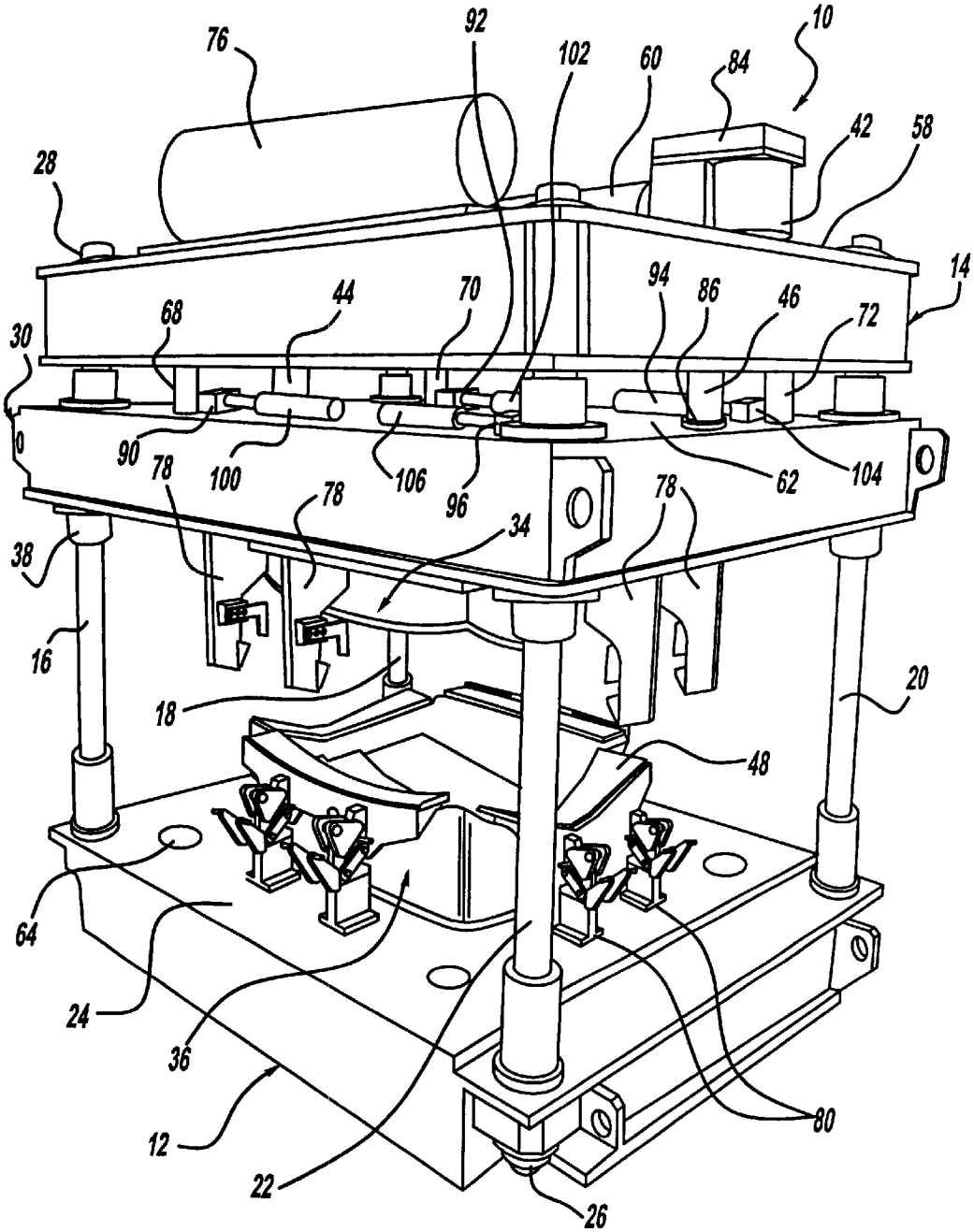
FIG. 1 is a perspective view of an electric hemming press, according to an embodiment of the present invention.
Figure 2:
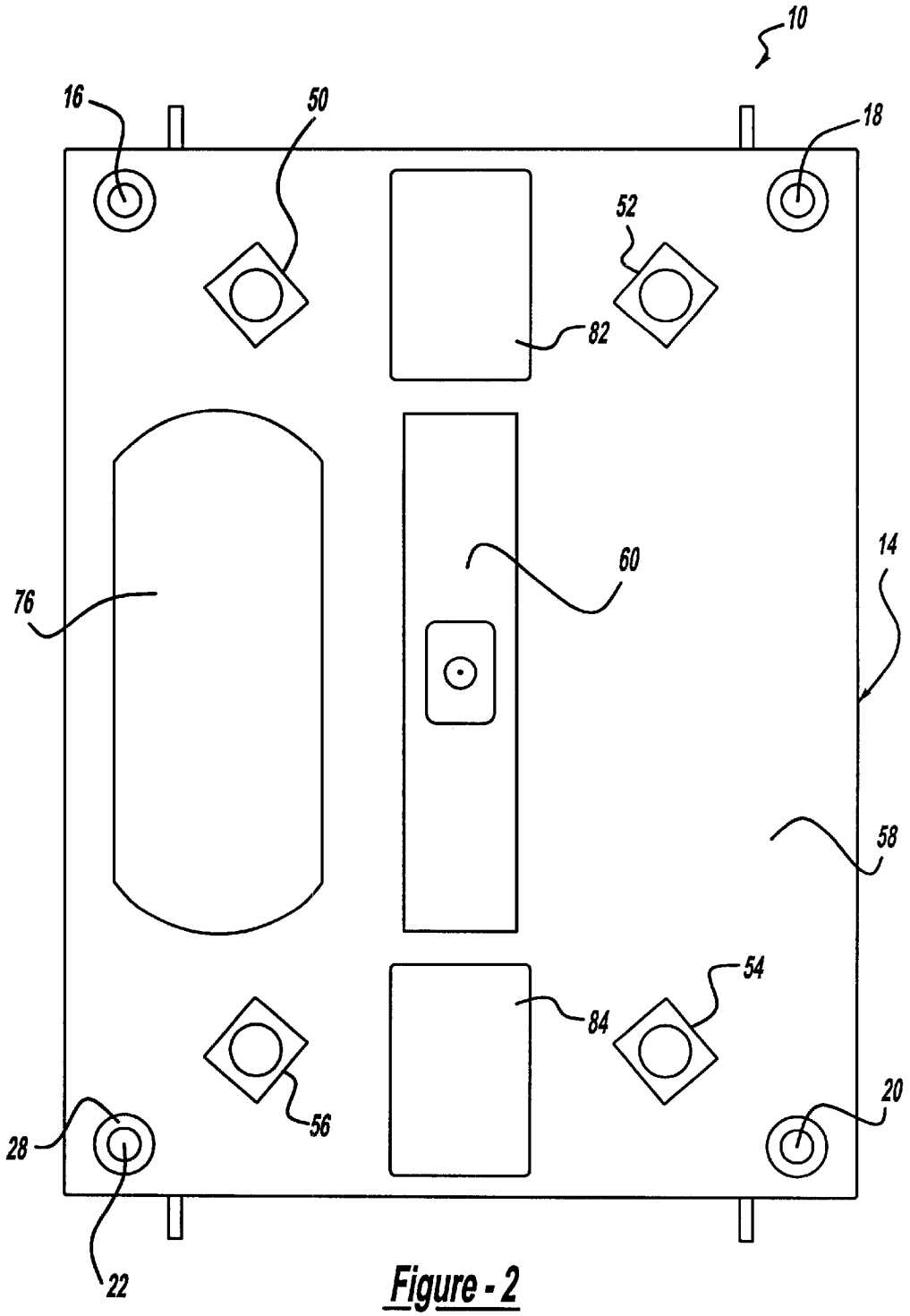
FIG. 2 is a top view of the hemming press shown in FIG. 1.
Figure 3:
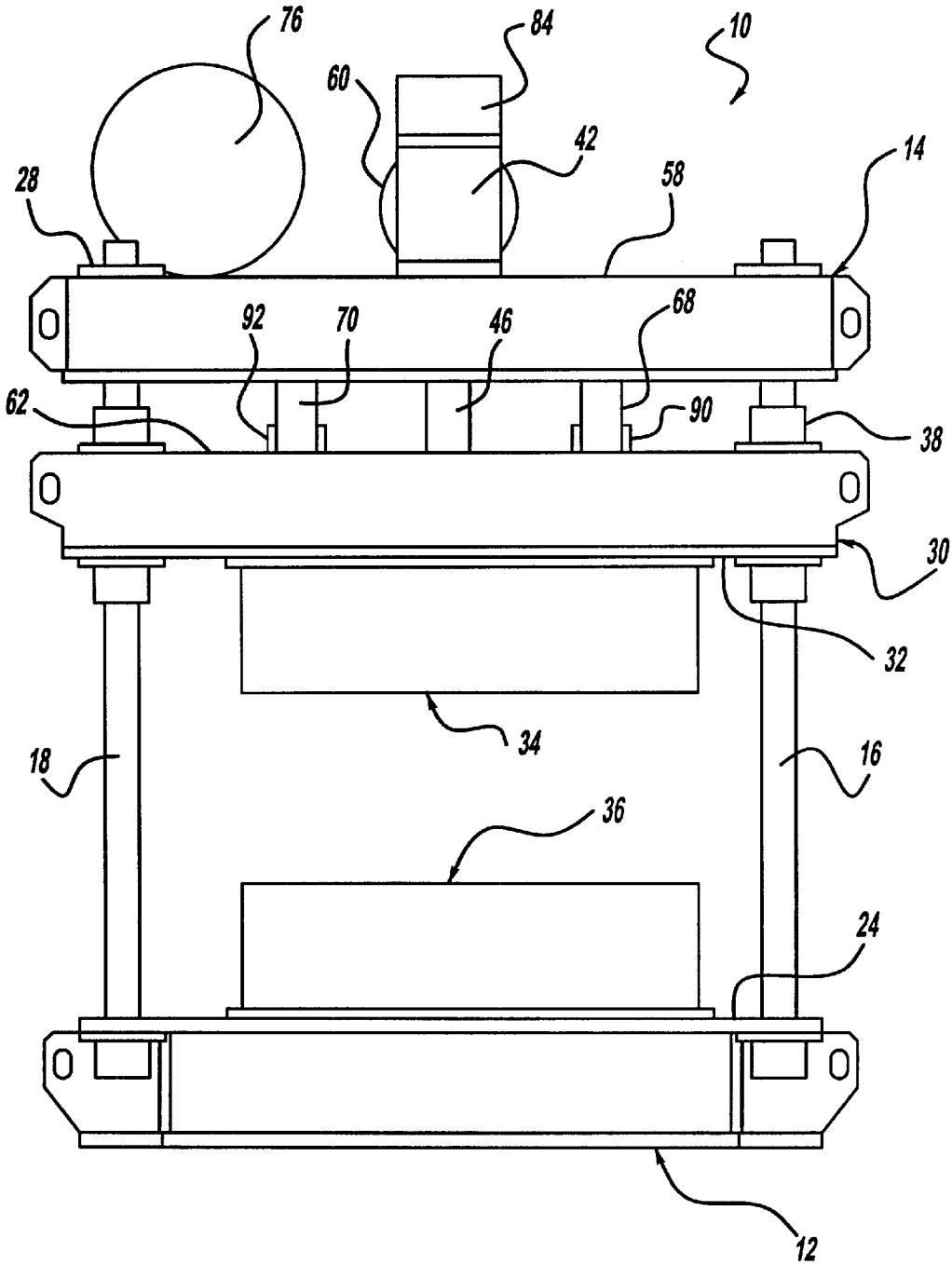
FIG. 3 is a side view of the hemming press shown in FIG. 1 where the press ram is in a home position.
Figure 4:
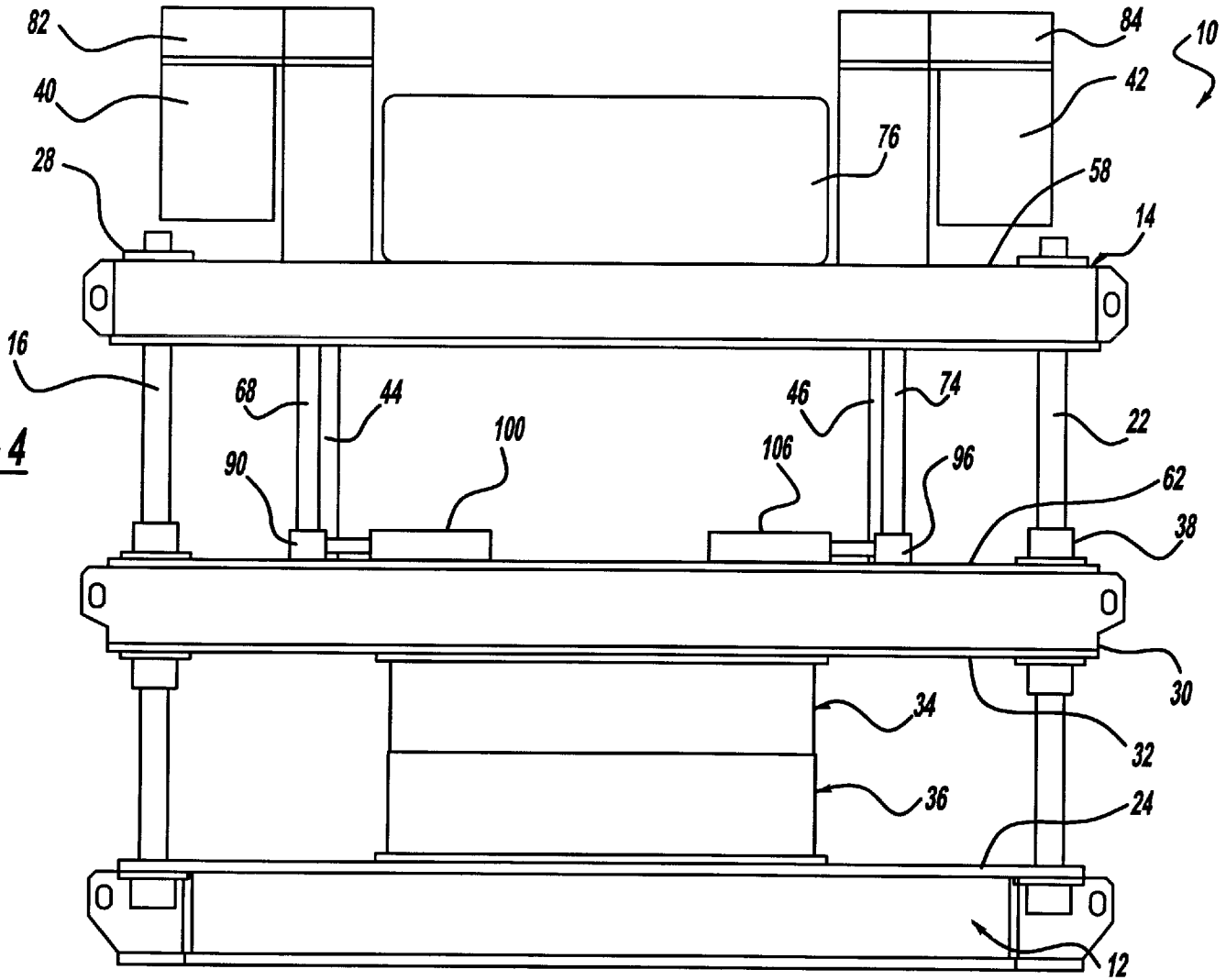
FIG. 4 is a side view of the hemming press shown in FIG. 1 where the press ram is in a hem position.

FIG. 1 is a perspective view, FIG. 2 is a top view and FIGS. 3 and 4 are separate side views of an electric hemming press 10, according to an embodiment of the present invention. As will be discussed in more detail below, the press 10 is a pressing machine that "hems" two pieces of formed sheet metal panels together. As is well understood in the art, the press 10 folds a flange of one sheet metal panel over an edge of another sheet metal panel so that the two panels are rigidly secured to each other. The press 10 has a particular application for automobile doors, which are typically formed of an outer and an inner sheet metal panel. A suitable press controller (not shown) would be provided in conjunction with the hemming press 10 to provide electrical control signals thereto during operation of the press 10. As will be discussed below, the hemming press 10 is operated by both electric motors and hydraulic cylinders, where the hydraulic cylinders are both air and fluid operated. The various electric, pneumatic and hydraulic lines are not shown in the figures for clarity purposes.

The press 10 includes a base plate 12 having shaped panels made of steel. The base plate 12 rests on a manufacturing floor in a production environment that is fully capable of supporting the pressing operation. The press 10 further includes a crown 14 having shaped panels made of steel similarly configured in size and shape to the base plate 12. In one embodiment, the base plate 12 and the crown 14 are 10 feet in length, 8 feet in width and 14 feet in height. The base plate 12 and the crown 14 are spaced apart by four separate steel posts 16, 18, 20 and 22, as shown. The posts 16–22 extend through and are secured to corner portions of the base plate 12 and the crown 14 by suitable couplers 26 and 28, respectively. The posts 16–22 give rigidity to the press 10.

A press ram 30 is slidably mounted on the posts 16–22. The ram 30 is a rectangular member, preferably made of steel, including suitable bores aligned with the posts 16–22 so that the press ram 30 can move up and down on the posts 16–22 between the base plate 12 and the crown 14. Suitable bushings 38 provided in the press ram 30 allow the press ram 30 to easily slide on the posts 16–22 with minimal friction.

A first die 34 is releasably mounted to a bottom surface 32 of the press ram 30, and a second die 36 is releasably mounted to a top surface 24 of the base plate 12, as shown. As is understood in the art, the metal panel workpieces (not shown) to be hemmed together are positioned on the die 36 in a certain orientation. Force is then applied to the press ram 30 so that it descends on the posts 16–22 allowing the die 34 to contact the workpieces. The force of the press ram 30 causes a flange of the outer metal panel to fold over along the edge of the inner metal panel to provide the hem.

The first die 34 includes alignment elements 78 that align with alignment elements 80 associated with the second die 36. When the press ram 30 descends, the elements 78 and 80 interact to cause die blades 48 to provide the prehem, as is well understood in the art. The alignment elements 78 and 80 and the die blades 48 are not shown in FIGS. 3 and 4 for clarity. The actuation of the press ram 30 will be discussed in more detail below. In one embodiment, hydraulic actuated die set lifters 64 are provided within the base plate 12 to remove the die 36.

A pair of roller screw linear actuators are mounted to a top surface of the crown 14. In one embodiment, suitable roller screws are available from EXLAR Corporation of Chanhassen, Minn. for this purpose. The linear actuators are positioned within cylinders 44 and 46, where the cylinders 44 and 46 extend through the crown 14. The roller screw linear actuators are coupled to a top surface 62 of the press ram 30 by a coupler 86. An electric servomotor 40 and 42 is separately coupled to each linear actuator by a coupler 82 and 84, respectively. In one embodiment, the servomotors 40 and 42 are 11 horsepower (8.2 kw) motors available from the Indramat Division of Mannesmann Rexroth of Hoffman Estates, Ill. Actuation of the actuators in response to the activation of the motors 40 and 42 causes the press ram 30 to descend or ascend depending on which direction the screws are rotated. The servomotors 40 and 42 operate on electricity, thus making them clean and less noisy.

Activation of the servomotors 40 and 42 causes the press ram 30 to descend towards the die 36. In one embodiment, the screw actuators are about 40 inches long, have a twenty-four inch travel, and move the press ram 30 under 20–30 tons of force. This force is used as a prehem force in the manner as discussed above, where the press ram 30 travels about 100–150 mm during the prehem stroke. In one embodiment, the servomotors 40 and 42 lower the press ram 30 to about 5 mm above the final hem position. Two servomotors and associated screws are provided in this embodiment, however, as will be appreciated by those skilled in the art, a single servomotor and associated screw or more than two servomotors and associated screws can be employed in other embodiments depending on the size of the press, the prehemming force desired, the size of the motors, etc.

When the press ram 30 is at the end of the prehem stroke, four hydraulic actuators 50, 52, 54 and 56 provide the pressure for the final hem. The hydraulic actuators 50–56 are mounted to the crown 14, and are connected to steel rods 68–74, respectively. The rods 68–74 extend through associated bores in the press ram 30. When the press ram 30 has descended to the beginning of the final hem position, the rods 68–74 are completely retracted from the bores (FIG. 4). In one embodiment, the combination of the hydraulic actuators 50–56, the rods 68–74 and a hydraulic booster tank 60 mounted to the top surface 58 of the crown 14 are all part of a commercially available system, for example, the Hypercyl System available from the Aries Engineering Company of Dundee, Mich. This system is an air over oil system where an air tank 76 mounted to the surface 58 provides the air pressure. Other hydraulic fluids, such as water, can be used in other designs within the scope of the present invention. In this embodiment there are four hydraulic actuators 50–56, however, this is by way of a non-limiting example in that other designs within the scope of the present invention may include more or less actuators depending on the parameters of the particular system.

Linearly actuated blocks 90–96 are slidably mounted to the top surface 62 of the press ram 30 adjacent to each bore. The position of the blocks 9096 are selectively movable by a suitable actuator, such as a pneumatic cylinder 100–106, respectively. The press controller activates the cylinders 100–106 to slide the blocks 90–96 over the bores once the press ram 30 has descended far enough so that the rods 68–74 are completely withdrawn from the bores. In this configuration, the rods 68–74 are aligned with the blocks 90–96 and can come in contact therewith. Another signal from the controller activates the hydraulic actuators 50–56 to cause the rods 68–74 to push against the blocks 90–96 providing a downward force on the press ram 30. This downward force provides the final hemming pressure for securing the workpieces together. In one embodiment, the stroke of the press ram 30 for the final hem is about 5 mm, and provides about 120 tons of force at 60 psi. After the final hem, air pressure raises the rods 68–74 off of the blocks 90–96.

According to the invention, the contact between the rods 68–74 and the respective blocks 90–96 is a floating contact in that the rods 68–74 can move laterally relative to the press ram 30. This provides the advantage that during the final hem step, lateral forces applied to the press ram 30 from the hemming operation do not adversely affect the coupling between the rods 68–74 and the blocks 90–96. In other words, because the rods 68–74 can move laterally with respect to the blocks 90–96, there is little wear and tear on this connection point that may otherwise exist in known designs.

Once the hemming process is complete, the rods 68–74 are lifted from the blocks 90–96. The controller then activates the cylinders 100–106 to slide the blocks 90–96 away from the bores so that the rods 68–74 are again aligned with the bores in the press ram 30. The servomotors 40 and 42 are then activated to cause the press ram 30 to ascend back to its home position so that the hemmed workpiece can be removed from the die 36.

This process is performed at a rate suitable to allow the workpieces to be placed in and removed from the die 36. Because the servomotors 40 and 42 and linear actuators are high efficiency and through other design configurations of the press ram 10, the press ram 10 can perform up to 240 jobs per hour, as compared to the industry average of about 100 to 120 jobs per hour. The four posts 16–22 and the four hydraulic actuators 50–56 provide more stability to the system, eliminating sway, and resulting in longer machine life.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A hemming press comprising:

a base plate;

a crown spaced from the base plate and supported thereon by a plurality of posts;

a press ram coupled to the crown and slidably mounted on the plurality of posts between a home position and a hem position;

at least one linear actuator and electric servomotor assembly mounted to the crown, said linear actuator being actuated by the servomotor to cause the press ram to ascend and descend on the posts; and at least one hydraulic actuator mounted to the crown, said hydraulic actuator including a rod extending down from the crown and being operable to contact the press ram and provide a hemming pressure thereto.

2. The press according to claim 1 wherein the rod extends through an opening in the press ram when the press ram is above the hem position.

3. The press according to claim 2 further comprising at least one slidable block mounted to a top surface of the press ram, said block being operable to slide over the opening so as to allow the rod to come in contact thereto.

4. The press according to claim 3 wherein the at least one hydraulic actuator causes the rod to descend and come in contact with the block to provide the hemming pressure to the press ram.

5. The press according to claim 4 wherein the contact between the rod and the block is a floating contact.

6. The press according to claim 1 wherein the at least one linear actuator and servomotor assembly is two electric servomotors and two linear actuators.

7. The press according to claim 1 wherein the linear actuator is a roller screw.

8. The press according to claim 1 wherein the at least one hydraulic actuator is four separate hydraulic actuators each including a rod that is aligned with a separate opening in the press ram.

9. The press according to claim 1 wherein the at least one hydraulic actuator is an air over hydraulic fluid actuator where the hydraulic fluid provides the hemming force to the rod and the air provides a return force.

10. A hemming press comprising:

a base plate;

a crown spaced from the base plate and supported thereon by a plurality of posts;

a press ram coupled to the crown and slidably mounted on the posts between a home position and hem position;

a plurality of electric servomotors mounted to the crown, each servomotor being mechanically coupled to a roller screw where activation of the servomotor causes the roller screw to rotate to cause the press ram to ascend or descend on the posts; and a plurality of hydraulic actuators mounted to the crown, each hydraulic actuator including a rod extending down from the crown through an opening in the press ram when the press ram is above the hem position, said rod being above the press ram when the press ram is in the hem position, wherein each rod is operable to come in contact with a separate block mounted to a top surface of the press ram and wherein activation of the hydraulic actuators provides a hemming pressure through the rods to the blocks to the press ram.

11. The press according to claim 10 wherein each block is slidably positionable relative to its respective opening by an actuator.

12. The press according to claim 10 wherein the contact between the rod and the block is a floating contact.

13. The press according to claim 10 wherein the plurality of hydraulic is four separate actuators each including a rod that is aligned with a separate opening in the press ram.

14. The press according to claim 10 wherein the plurality of hydraulic actuators are four air over hydraulic fluid actuators where the hydraulic fluid provides the hemming force to the rod and the air provides a return force.

15. A hemming press for hemming together an inner metal panel and outer metal panel, said press comprising:

a base plate made of a plurality of steel panels;

a crown made of a plurality of steel panels and spaced from the base plate, said crown being supported on the base plate by a plurality of posts;

a press ram made of a plurality of steel plates and being slidably mounted on the plurality of posts between a home position and a hem position, said press ram including a plurality of openings extending therethrough;

a separate block and block actuator mounted to a top surface of the press ram adjacent to each opening, said block actuator being activated to slide the block over the respective opening;

a plurality of electric servomotors mounted to the crown, each servomotor being coupled to a roller screw, said roller screw being actuated by the servomotor to cause the press ram to ascend and descend on the posts; and a plurality of hydraulic actuators mounted to the crown, each hydraulic actuator including a rod extending down from the crown and through a respective opening in the press ram when the press ram is above the hem position, said rods being operable to contact the blocks when the press ram is in the hem position and the blocks have been slid over the openings so as to provide a hemming pressure to the press ram, wherein the contact between the rod and the block is a floating contact.

16. The press according to claim 15 wherein the plurality of servomotors is two electric servomotors and the plurality of hydraulic actuators is four separate hydraulic actuators.

17. The press according to claim 15 wherein the plurality of hydraulic actuators are air over hydraulic fluid actuators where the hydraulic fluid provides the hemming force to the rod and the air provides a return force.

* * * * *

UNITED STATES PATENT AND TRADEMARK OFFICE

CERTIFICATE OF CORRECTION

PATENT NO. : 6,640,601 B2
DATED : November 4, 2003
INVENTOR(S) : Thomas J. Hatty It is certified that error appears in the above-identified patent and that said Letters Patent is hereby corrected as shown below:

Column 6,
Line 46, after "hydraulic" insert -- actuators --.

Signed and Sealed this

Eleventh Day of May, 2004

JON W. DUDAS
*Acting Director of the United States Patent and Trademark Office*